US010462886B2

(12) United States Patent
LeClair et al.

(10) Patent No.: US 10,462,886 B2
(45) Date of Patent: Oct. 29, 2019

(54) HIGH TEMPERATURE X-RAY TUBE ASSEMBLY

(71) Applicant: MICRO X-RAY, Santa Cruz, CA (US)

(72) Inventors: Michael LeClair, Santa Cruz, CA (US); Zoltan Szilagyi, Santa Cruz, CA (US)

(73) Assignee: Micro X-Ray, Santa Cruz, CA (US)

( * ) Notice: Subject to any disclaimer, the term of this patent is extended or adjusted under 35 U.S.C. 154(b) by 165 days.

(21) Appl. No.: 15/688,715

(22) Filed: Aug. 28, 2017

(65) Prior Publication Data

US 2019/0069383 A1 Feb. 28, 2019

(51) Int. Cl.

| | |
|---|---|
| ***H05G 1/04*** | (2006.01) |
| ***H05G 1/02*** | (2006.01) |
| ***H01J 35/16*** | (2006.01) |

(52) U.S. Cl.

CPC ..... *H05G 1/025* (2013.01); *H01J 35/16* (2013.01); *H05G 1/04* (2013.01); *H01J 35/165* (2013.01); *H01J 2235/1204* (2013.01)

(58) Field of Classification Search

CPC ..... H05G 1/025; H05G 1/04; H01J 35/16

See application file for complete search history.

(56) References Cited

U.S. PATENT DOCUMENTS

2014/0050305 A1* 2/2014 Zhao ..... G01N 23/04 378/141

2015/0139406 A1 5/2015 Hansen et al.

* cited by examiner

*Primary Examiner* — Mark R Gaworecki

(74) *Attorney, Agent, or Firm* — Vierra Magen Marcus LLP

(57) ABSTRACT

Described herein is an x-ray tube assembly that includes: a housing that encloses an inner volume; a movable divider within the inner volume, the movable divider dividing the inner volume into a first volume and a second volume; an x-ray tube within the first volume; the first volume between the housing and the x-ray tube filled with an insulating fluid; and the second volume filled with a compressible gas.

29 Claims, 6 Drawing Sheets

HIGH TEMPERATURE X-RAY TUBE ASSEMBLY

BACKGROUND

The present disclosure relates to x-ray tube technology.

X-ray radiation is used for a range of applications. Sources of x-ray radiation are used as components in a range of systems with applications in areas such as medicine, dentistry, manufacturing, agriculture, and scientific research. A source of x-ray radiation may include an x-ray tube in which electrons are emitted from a cathode, accelerated, and directed at a target material at an anode that emits x-ray radiation (or "x-rays"). X-ray tubes generally have an interior at high-vacuum and are sealed so that the vacuum is maintained. High voltages may be applied between an anode and cathode to generate x-rays and significant heat may be generated as a result. Some form of housing may be provided around x-ray tubes to shield the surroundings from unwanted x-ray radiation. Providing a housing that accommodates high temperatures generated by an x-ray tube and that allows coupling of high voltage to the x-ray tube in a reliable manner, while providing protection from unwanted x-ray radiation, within a limited space, is challenging.

DETAILED DESCRIPTION

Certain embodiments of the present technology described herein relate to generation of x-ray radiation and to equipment associated with generation of x-ray radiation. For example, certain embodiments relate to housings for x-ray tubes that allow a high-voltage to be supplied to an x-ray tube while accommodating the high temperatures generated by the x-ray tube.

In an example, high temperatures are accommodated by filling a portion of the interior volume of a housing with oil or other insulating fluid that provides good heat transfer from the x-ray tube and provides electrical insulation between the x-ray tube and the housing. Another portion of the interior volume of the housing may be filled with a gas, such as an inert gas (e.g. Nitrogen, Argon), air, or another compressible gas, to allow for expansion of the oil at high temperatures through compression of the gas and/or venting of gas. A movable divider may separate the two portions so that the gas remains in a predetermined location that is removed from the x-ray tube. For example, a piston or cup shaped divider may be slidable within a cylindrically-shaped interior volume of a housing so that one end of the interior volume remains gas-filled while the rest of the interior volume is oil-filled.

High voltage may be supplied to the x-ray tube through a high-voltage lead that includes an electrical conductor with one or more layers of solid insulator to isolate the electrical conductor from insulating fluid in the interior volume of the housing. A connector at the end of the high-voltage lead provides ease of coupling and decoupling. With only solid insulators around the electrical conductor and with gas isolated from the oil within the interior volume, the oil-filled portion of the interior is gas-free which provides good reliability, while remaining free to expand at high temperatures.

Figure 1:
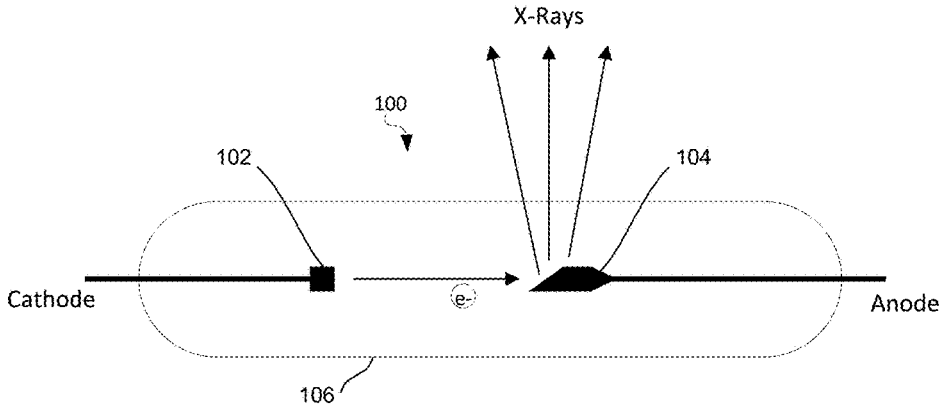
FIG. 1 shows an example of an x-ray tube.

FIG. 1 shows an example of an x-ray tube 100 producing x-ray radiation. A cathode 102 and an anode 104 are arranged within glass wall 106. Glass wall 106 seals an interior volume 108 that is at high vacuum (e.g. in the millitorr range, for example, $1\times10-9$ torr). Cathode 102 may be a heated filament that is supplied with a current to heat it to a temperature that frees electrons that are then accelerated from cathode 102 towards anode 104 by a voltage applied between cathode 102 and anode 104. For example, cathode 102 may be maintained at or near ground while a high (positive) voltage is applied to anode 104. A high voltage (e.g. in the range of greater than 4 kV) applied between cathode 102 and anode 104 accelerates electrons to a high enough velocity so that they strike anode 104 with sufficient energy to produce x-ray radiation. Anode 104 may include a portion of a suitable target material such as Tungsten (W), Copper (Cu), Rhodium (Rh), Molybdenum (Mb), Silver (Ag), Chromium (Cr), Palladium (Pd), Cobalt (Co), Gold (Au), Iron (Fe), or other suitable metal. Anode 104 may be shaped so that x-ray radiation generated at the surface where electrons strike is directed in a desired orientation (e.g. upwards in the example of FIG. 1).

While x-ray radiation may be generally directed in a desired orientation by geometry of x-ray tube components, significant x-ray radiation may be emitted in other directions from a target. Accordingly, some form of housing may be provided around an x-ray tube to shield the surroundings from unwanted x-ray radiation. Such a housing may include one or more material that block x-ray radiation (e.g. lead, or a material containing lead such as bronze or brass). An opening in the housing (e.g. a window) allows x-ray radiation to be emitted in the desired direction.

In general, an x-ray tube heats up as it is used. While some of the electrical energy provided to an x-ray tube is converted to electromagnetic energy of emitted x-ray radiation, a significant portion of the electrical energy generates heat. The amount of heat generated depends on a number of factors including the geometry of the x-ray tube components, cathode-anode voltage, etc. Where an x-ray tube is operated within a housing, adequate heat transfer must be provided to ensure that the inner volume enclosed by the housing remains within an acceptable temperature range to avoid overheating the x-ray tube. An electrically insulating fluid may be provided within a housing to provide electrical insulation while also providing efficient heat transfer between an x-ray tube and the walls of a housing. However, the presence of an insulating fluid provides additional challenges.

In general, an insulating fluid used to provide good heat transfer in the inner volume of a housing may be expected to expand as temperature increases, which causes increased pressure and damage if not accommodated. Providing a reliable high-voltage connection within a liquid-filled inner volume of a housing provides challenges, particularly where such a connection is to be subjected to significant heat, significant x-ray radiation, and may be subject to high pressure as insulating fluid heats up.

Figure 2:
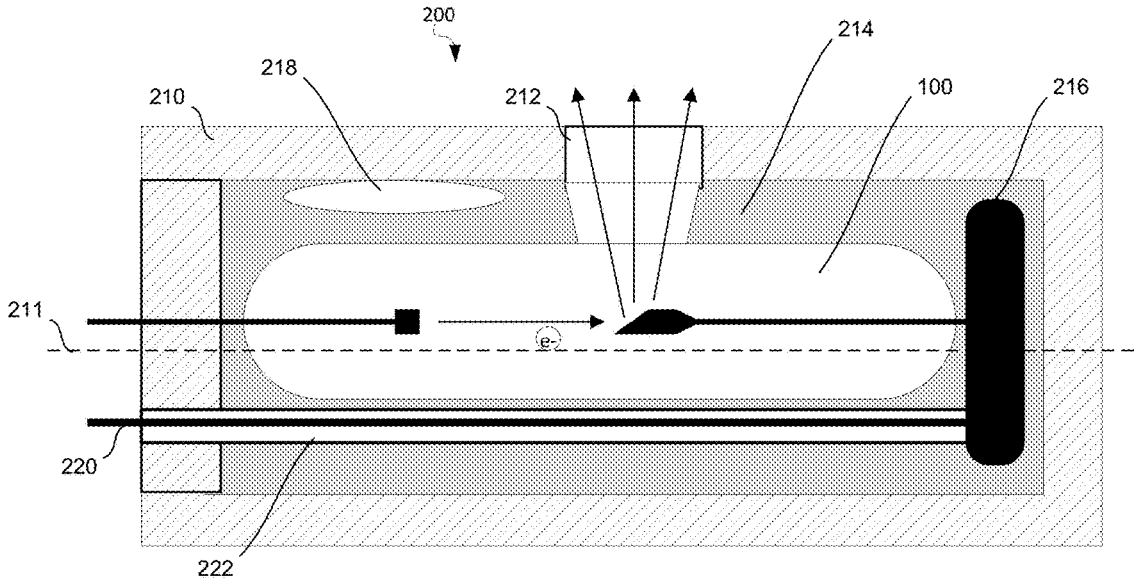
FIG. 2 shows an example of an x-ray tube assembly including a housing and insulating fluid.

FIG. 2 shows an example of an x-ray tube assembly 200 that includes a housing 210 formed of a suitable material to block x-ray radiation with a window 212 that allows x-ray radiation to be emitted in a desired direction. X-ray tube 100 is located within housing 210. An insulating fluid 214 is also located within housing 210 to provide efficient heat transfer from x-ray tube 100 to housing 210. A heat sink 216 is attached to the anode terminal of x-ray tube 100 to facilitate heat transfer from the anode. Heat sink 216 is immersed in insulating fluid 214 so that there is efficient heat transfer from heat sink 216 to insulating fluid 214. Housing 210 is cylindrical about a central axis 211 (i.e. has cylindrical symmetry about central axis 211, with some additional features such as window 212).

FIG. 2 shows a bubble 218 in housing 210. Bubble 218 may be air, or an inert gas such as Nitrogen, or some other gas. While a bubble such as bubble 218 allows for some expansion of insulating fluid 214 with increased temperature, the presence of such a bubble may have undesirable consequences. In some cases, a bubble at a particular location may provide a relatively low-resistance pathway between high-voltage elements and housing 210 so that electrical arcing may occur. The existence of low-resistance pathways may depend on the locations of any bubbles which may change over time (e.g. according to orientation of an x-ray tube assembly). Thus, an x-ray tube assembly may meet a specification during testing and later fail when in use in an unpredictable manner.

FIG. 2 also shows a high-voltage conductor 220 that supplies a high voltage to the anode terminal of x-ray tube 100 through heat sink 216. High-voltage conductor 220 extends through a tube 222 that is filled with air or another gas. The interior of tube 222 may be sealed and placed in position prior to filling interior volume of housing 210 with insulating fluid so that it remains isolated from insulating fluid. While gas in tube 222 may provide electrical isolation, this arrangement may not be reliable over time as some oil may leak into tube 222 and affect its characteristics.

Figure 3A:
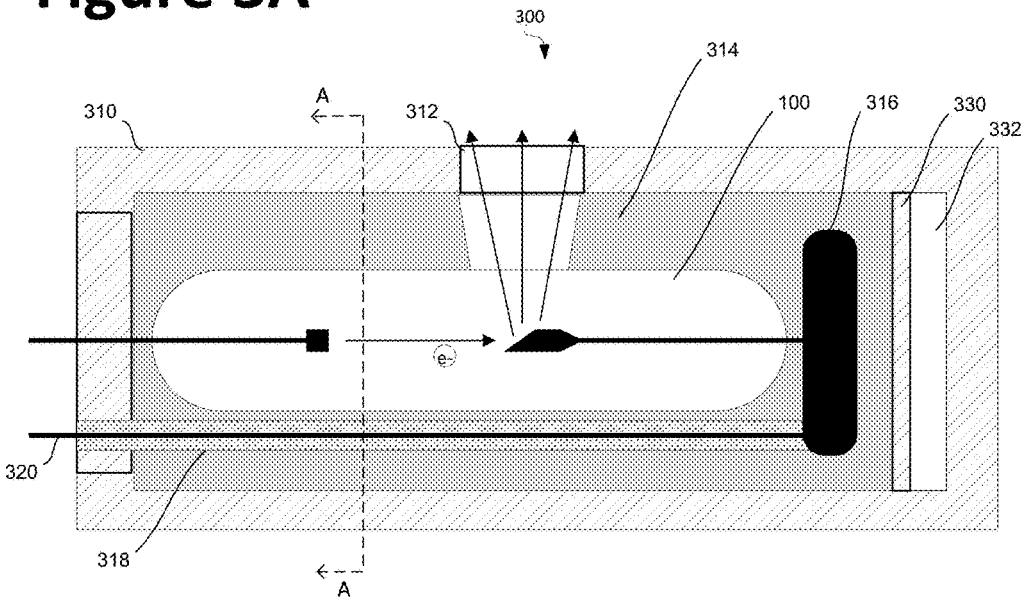
FIGS. 3A-B show an example of an x-ray tube assembly that includes a movable divider between an insulating fluid filled volume and a volume containing air.

FIG. 3A shows an alternative, x-ray tube assembly 300 that includes several features that are similar to those of x-ray tube assembly 200. X-ray tube assembly 300 includes a housing 310 formed of a suitable material to block x-ray radiation (e.g. bronze with a lead content of about 8% or brass with a lead content of about 3%) with a window 312 that allows x-ray radiation to be emitted in a desired direction. X-ray tube 100 is located within housing 310. An insulating fluid 314 is also located within housing 310 to provide efficient heat transfer from x-ray tube 100 to housing 310. Insulating fluid 314 may be a suitable liquid that convects heat efficiently while providing good electrical isolation (i.e. good convection and high dielectric strength). Examples of suitable insulating fluids include transformer oils such as Diala Oil, pentaerythritol tetra fatty acid, or synthetic esters. A heat sink 316 is attached to the anode terminal of x-ray tube 100 to facilitate heat transfer from the anode. Heat sink 316 is immersed in insulating fluid 314 so that there is efficient heat transfer from heat sink 316.

X-ray tube assembly 300 includes several features that facilitate reliable high-temperature operation. In contrast to x-ray tube assembly 200, no gas bubbles are present in insulating fluid 314 and no gas is provided around the high-voltage conductor. A movable divider 330 divides the internal volume of housing 310 into two portions, a first portion that is filled with insulating fluid 314 (to the left of movable divider 330 in FIG. 3A) and a second portion that contains air 332 (to the right of movable divider 330 in FIG. 3A). Movable divider 330 may move from left to right in this example to allow for expansion of insulating fluid 314. A movable divider may be formed of a solid material and may be shaped to slide within the interior of the housing (e.g. outer surface of a movable divider may engage inner wall of housing with some clearance to allow sliding). As insulating fluid 314 expands, it pushes movable divider 330 to the right thereby pushing some of air 332 out (through a vent that is not illustrated). As insulating fluid 314 cools and contracts after use, movable divider 330 is pushed to the left by air 332. Stops may be provided to limit the range of travel of movable divider 330 to a suitable range that corresponds to the expansion and contraction of insulating fluid 314 over the temperature range of x-ray tube assembly 300. Unlike having a bubble as shown in FIG. 2, air 332 is confined to a predetermined location and is separated from insulating fluid 314. The location of movable divider 330 ensures that air 332 does not facilitate arcing (e.g. because the location and geometry of air 332 with respect to high-voltage elements does not provide a pathway for discharge between high-voltage elements and housing 310). Isolation of air 332 from insulating fluid 314 may prevent interaction between air 332 and insulating fluid 314 (e.g. none of air 332 becomes dissolved in insulating fluid 314, and no chemical interactions occur).

FIG. 3A shows a high-voltage conductor 320 that provides a high voltage to heat sink 316, which is connected to the anode of x-ray tube 100. High-voltage conductor 320 may be made of a suitable material with low electrical resistance, for example, Nickel-plated Copper. Surrounding high-voltage conductor 320 is a solid insulation layer 318 that isolates high-voltage conductor 320 from insulating fluid 314. Solid insulation layer 318 may be formed as a single layer of a single material or may be comprised of multiple layers of one or more solid materials. Solid insulation material extends from high-voltage conductor 320 to insulating fluid 314 without air or any other gas between them. The use of solid insulation provides a reliable gas-free high-voltage coupling.

Figure 3B:
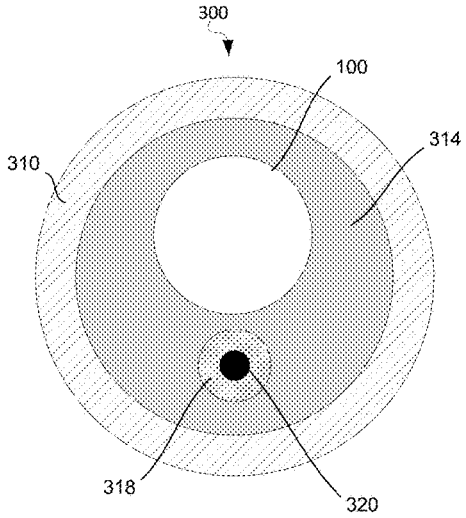

FIG. 3B shows x-ray tube assembly 300 in cross section along a plane perpendicular to its axis. It can be seen that x-ray tube assembly 300 is cylindrical in shape (circular in cross section of FIG. 3B, which is along A-A of FIG. 3A). X-ray tube 100 is surrounded by insulating fluid 314 that is gas-free (e.g. transformer oil that is free from bubbles and substantially free from dissolved gas). Only solid insulation layer 318 is present between high-voltage conductor 320 and insulating fluid 314 (no air or other gas).

Figure 4A:
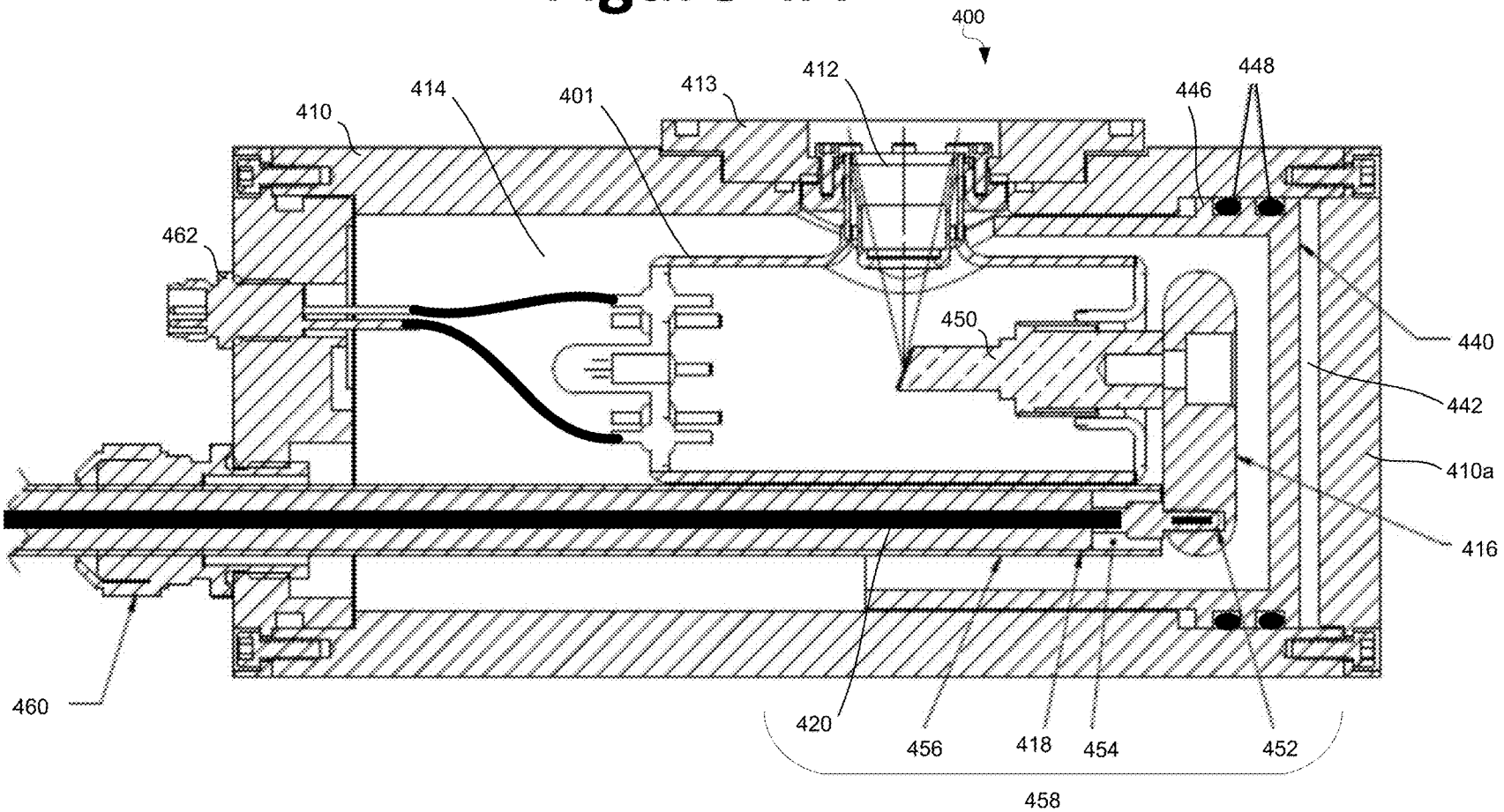
FIGS. 4A-C show another example of an x-ray tube assembly that includes a movable divider between an insulating fluid filled volume and a compressible gas-filled volume.

FIG. 4A shows another example of an x-ray tube assembly 400 that is adapted for reliable high-temperature operation. X-ray tube assembly 400 includes a housing 410 formed of a suitable material to block x-ray radiation with a window 412 that allows x-ray radiation to be emitted in a desired direction. X-ray tube 401 is located within housing 410 and is attached to housing 410 by window 412 (e.g. window 412 may be fused to x-ray tube 401) using a flange 413. An insulating fluid 414 is also located within housing 410 to provide efficient heat transfer from x-ray tube 401 to housing 410. A heat sink 416 is attached to the anode terminal of x-ray tube 401 to facilitate heat transfer from the anode of x-ray tube 401.

A movable divider 440 divides the internal volume of housing 410 into two portions, a first portion that is filled with insulating fluid 414 (to the left of movable divider 440 in FIG. 4A) and a second portion that is filled with a compressible gas or air 442 (to the right of movable divider 440 in FIG. 4A). Movable divider 440 may move from left to right in this example to allow for expansion of insulating fluid 414. Movable divider 440 is a solid cup-shaped component that is formed from a suitable material such as Delrin, or other electrically insulating material that can withstand x-ray radiation. As insulating fluid 414 expands, it pushes movable divider 440 to the right thereby displacing air 442 through a vent (not shown). As insulating fluid 414 cools and contracts after use, movable divider 440 is pushed to the left by pulling in air 442. Thus, movable divider 440 moves as a piston within housing 410. The range of travel of movable divider 440 is limited to a suitable range that corresponds to the expansion and contraction of insulating fluid 414 over the temperature range of x-ray tube assembly 400. The end portion 410*a* of housing 410 establishes a limit on the right. The volume of insulating fluid 414 at room temperature may establish a limit on the left, or one or more protruding rings such as ring 446 may limit travel to the left. Isolation of air gap 442 from insulating fluid 414 is achieved with O-rings 448 that extend about movable divider 440 and seal against the inner surface of housing 410. O-rings 448 may be maintained in place by retain rings such as ring 446 so that ring 446 serves two functions—retaining O-rings 448 in place and providing a stop position for movable divider 440. Ensuring isolation may prevent interaction between air 442 and insulating fluid 414. In some cases, housing 410 may be filled with insulating fluid 414 under vacuum to ensure that no dissolved gasses remain in insulating fluid 414 during manufacturing. This may improve dielectric strength and avoid later bubble formation. Compressible gas 442 may be a suitable gas that is pumped in at a predetermined pressure that is greater than atmospheric pressure (e.g. 20 psi).

FIG. 4A shows a high-voltage conductor 420 that provides a high voltage to heat sink 416, which is connected to anode 450 of x-ray tube 401. High-voltage conductor 420 may be made of a suitable material with low electrical resistance, for example, Nickel-plated Copper. Surrounding high-voltage conductor 420 is a solid insulation layer 418 that isolates high-voltage conductor 420 from insulating fluid 414. Solid insulation layer 418 may be formed as a single layer of a single material or may be comprised of multiple layers of one or more solid materials. For example, solid insulation layer 418 may be a layer of Ethylene Propylene Rubber (EPR) insulation. High-voltage conductor 420 is coupled to a connector 452 (e.g. crimped, soldered, or otherwise attached to provide good electrical contact. Connector 452 fits in a corresponding receptacle in heat sink 416. For example, connector 452 may be a banana connector that fits into a hole in heat sink 416. The joint between high-voltage conductor 420 and connector 452 is sealed with sealant 454, which may be a high-temperature epoxy. A tube 456 of suitable material extends around both solid insulation layer 418 and sealant 454 to form an additional protective barrier and to seal the interface between solid insulation layer 418 and sealant 454. For example, Viton shrink tubing may be used to form tube 456. The assembly formed by high-voltage conductor 420, connector 452, solid insulation layer 418, sealant 454, and tube 456 may be considered a high-voltage lead 458. A chord grip seal 460 seals between high-voltage lead 458 and housing 410 to prevent leakage of insulating fluid 414 and to prevent entry of air into housing 410 around high-voltage lead 458. Cathode terminal 462 may be similarly sealed to prevent leakage of insulating fluid 414 or entry of air into housing 410. A thermal switch may be provided in cathode terminal 462 to shut off cathode current and stop x-ray tube operation when temperature exceeds a predetermined threshold.

Figure 4B:
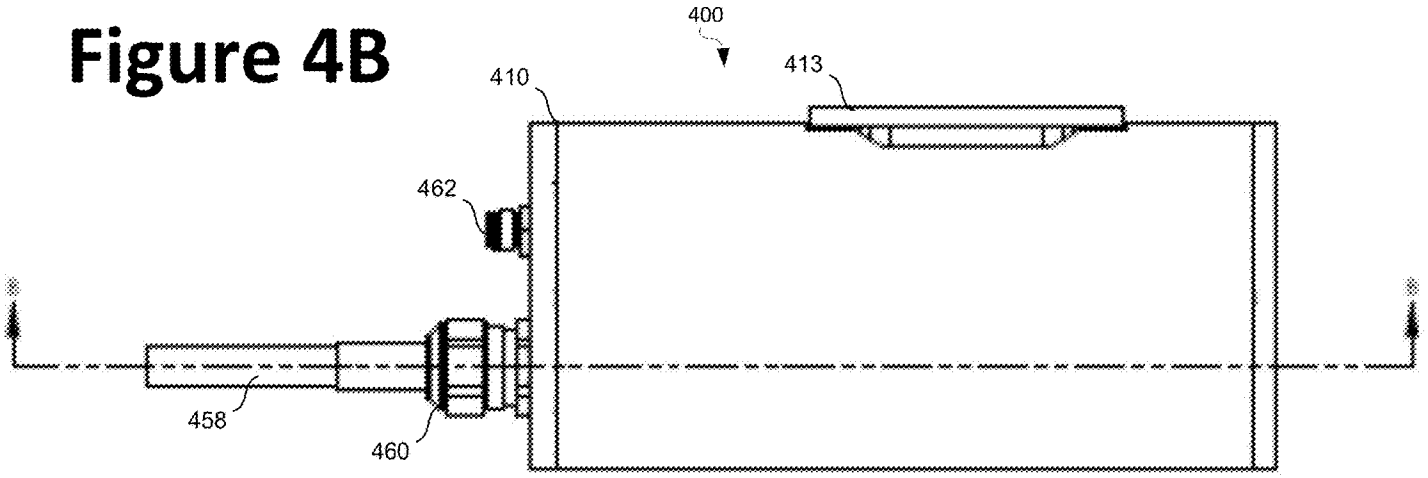

FIG. 4B shows an external view of x-ray tube assembly 400 including housing 410, flange 413 (for window 412, which is not visible from this perspective), cathode terminal 462, high-voltage lead 458 and chord grip seal 460.

Figure 4C:
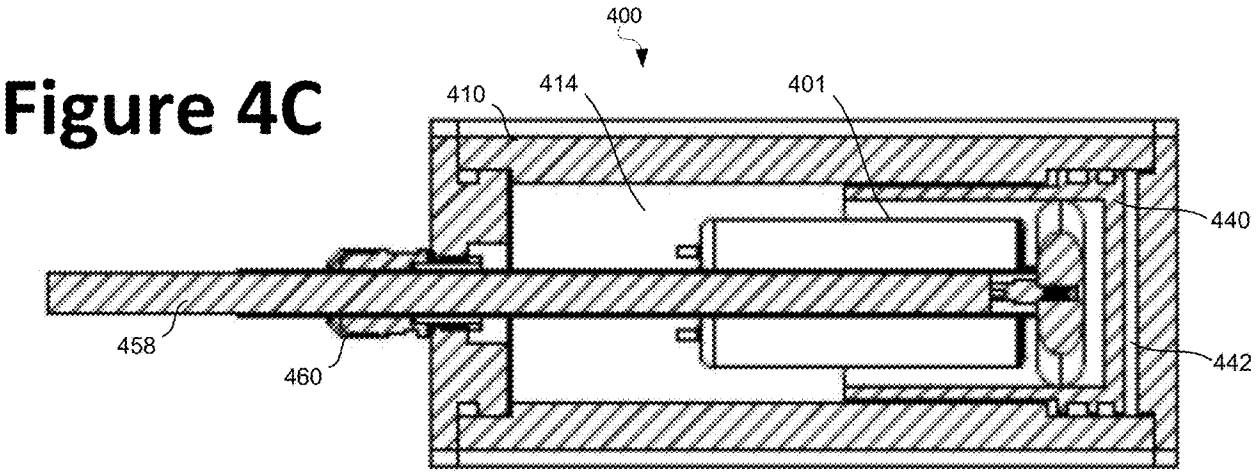

FIG. 4C shows a cross sectional view of x-ray tube assembly 400 along B-B of FIG. 4B (cross section through high-voltage lead 458 and chord grip seal 460 looking upwards, towards the window and flange 413). FIG. 4C shows movable divider 440 that divides the interior volume of housing 410 into a volume filled with insulating fluid 414 and another volume filled with air 442. It can be seen from FIGS. 4A-C that the interior volume of housing 410 is cylindrical in shape and that movable divider 440 has a substantially cylindrical outer surface that allows it to slide axially along the direction of the cylinder as a piston.

Figure 5:
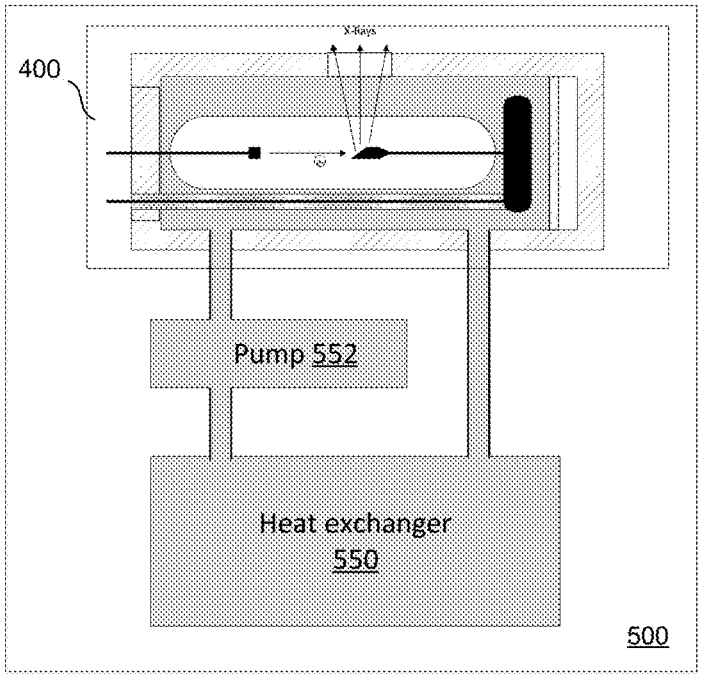
FIG. 5 shows an assembly that includes a heat exchanger for insulating fluid in an x-ray tube assembly.

X-ray tube assemblies such as shown above may be incorporated in larger assemblies with additional components. For example, in some cases, oil or other insulating fluid in an x-ray tube assembly may be circulated through a heat exchanger to dissipate heat for high power applications (e.g. applications using over 75 watts, or over 100 watts). FIG. 5 shows an example of an x-ray tube assembly 400 incorporated in a larger assembly 500 that includes a heat exchanger 550 and a pump 552. Pump 552 circulates insulating fluid between x-ray tube assembly 400 and heat exchanger 550 so that heat is removed from the interior of x-ray tube assembly 400.

Figure 6:
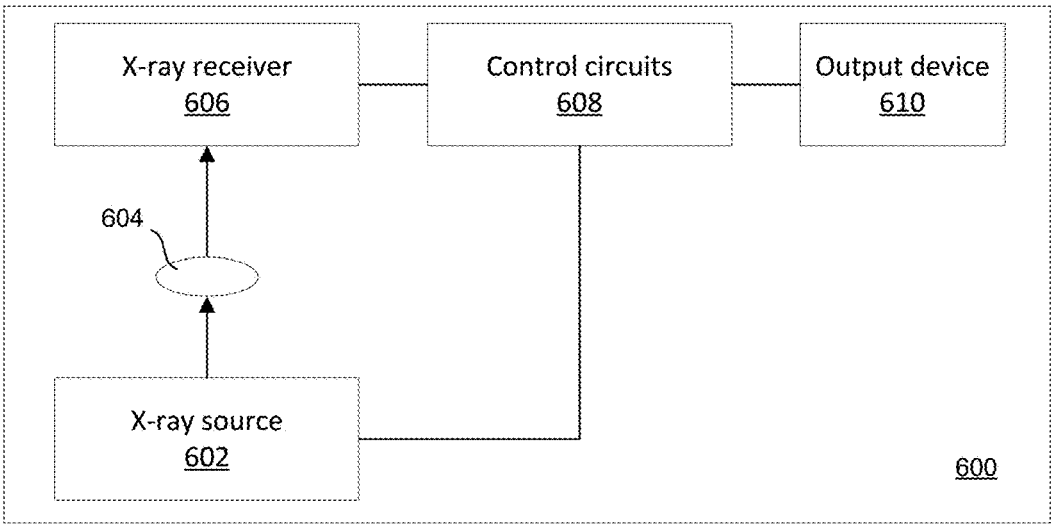
FIG. 6 shows an x-ray system that includes an x-ray source and x-ray receiver.

X-ray tube assemblies such as shown above may be used as x-ray sources in a range of different systems for a wide range of applications including industrial applications, medical applications, research applications, and others. FIG. 6 shows an example of an apparatus that includes an x-ray source 602 that may include an x-ray tube assembly as described above (e.g. x-ray tube assembly 300, 400, 500 or similar x-ray assembly). X-ray radiation from x-ray source 602 is directed at an object 604. For example, object 604 may be a substrate such as an integrated circuit, printed circuit board (PCB), a sample for analysis (e.g. thickness analysis, or material analysis, or other analysis), a patient receiving a diagnostic x-ray analysis, or some other object. X-ray receiver 606 receives x-ray radiation from object 604. X-ray radiation received by x-ray receiver 606 may be radiation from x-ray source 602 that has passed through object 604, or may be x-ray radiation produced by object 604 as a result of exposure to x-ray radiation from x-ray source 602 (e.g. x-ray fluorescence). X-ray receiver 606 provides an output to control circuits 608 according to x-ray radiation received from object 604. Control circuits 608 then use the output from x-ray receiver 606 to generate an output to an output device 610, which may provide a visible output (one or more lights or displays, such as LED or LCD display, etc.), audio output (tone, alarm, voice output, etc.), a digital output (e.g. digital data as internet protocol packets, or otherwise, that may be sent over a network such as a cellular network, local area network, wide area network, the Internet) or other output. Control circuits 608 are also connected to x-ray source 602 and may control x-ray source 602. For example, control circuits 608 may control power and duration of x-ray radiation directed at object 604.

In an example, x-ray receiver 606 receives x-ray radiation from x-ray source 602 that passes through object 604 and the intensity of the received x-ray radiation is correlated with thickness of object 604 (i.e. radiation is increasingly attenuated with increasing thickness). Control circuits 608 may store calibration data (e.g. a lookup table) and may determine thickness from intensity values provided by x-ray receiver 606. Thickness values may then be output by output device 610 (e.g. displayed on a screen, or encoded and sent over a network).

In an example, x-ray receiver 606 includes an array of sensors that receive x-ray radiation that passes through object 604 and control circuits 608 generate image data accordingly. X-ray images may be displayed by output device 610 so that internal features of object 604 that cannot be seen in the visible spectrum can be observed (e.g. bones in a patient, decay in a tooth, defects within an integrated circuit, PCB, or other article of manufacture).

In an example, x-ray receiver 606 receives x-ray radiation generated by object 604 when it is exposed to x-ray radiation from x-ray source 602, such as x-ray radiation produced by x-ray fluorescence. In general, such x-ray radiation is generated at wavelengths that are characteristic of the material, or materials, of object 604. X-ray receiver 606 may provide an output that indicates x-ray intensity across a range of wavelengths and control circuits 608 may generate a graphical illustration of intensity as a function of wavelength at output device 610, or may infer material composition of object 604 from intensity/wavelength data (e.g. by comparing received spectral data from x-ray receiver with stored spectral data for known materials).

Figure 7:
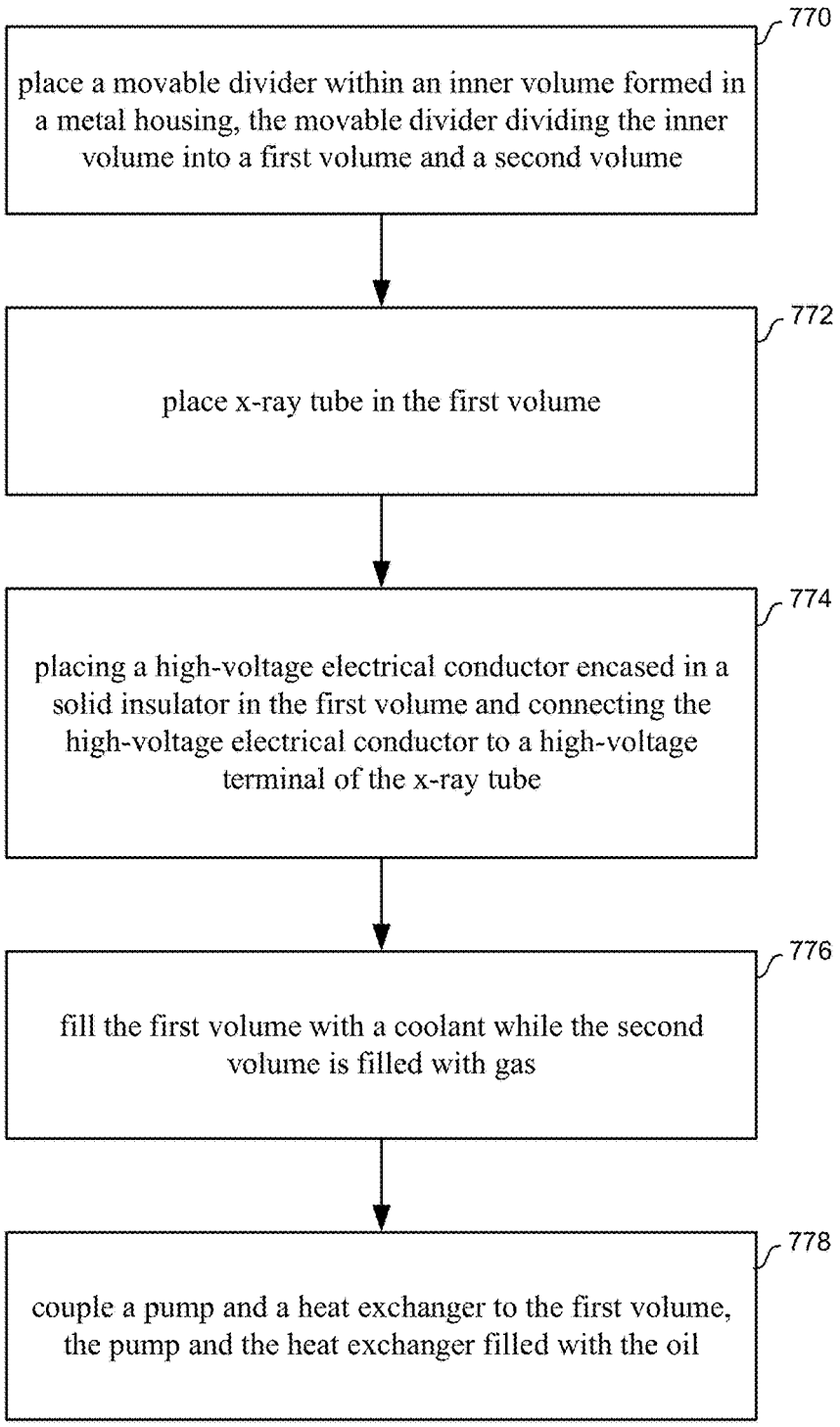
FIG. 7 illustrates a method of making an x-ray tube assembly.

FIG. 7 illustrates a method of housing an x-ray tube that may be used to form an x-ray tube assembly as described above (e.g. x-ray tube assembly 300, 400, 500, or other x-ray tube assembly). A movable divider is placed within an inner volume formed in a metal housing, the movable divider dividing the inner volume into a first volume and a second volume 770. The x-ray tube is placed in the first volume 772. A high-voltage electrical conductor encased in a solid insulator is placed in the first volume and the high-voltage electrical conductor is connected to a high-voltage terminal of the x-ray tube 774 (e.g. through a heat sink). The first volume is filled with an insulating fluid such as oil while the second volume is filled with gas 776 such as air. For example, a transformer oil may fill the first volume with a vacuum applied to eliminate all or substantially all gas from the transformer oil and the gas may be introduced under pressure (i.e. greater than atmospheric pressure) or at atmospheric pressure (e.g. through a vent to the exterior of a housing). Optionally, a pump and a heat exchanger may be coupled to the first volume, the pump and the heat exchanger filled with the oil 778.

An example of an x-ray tube assembly includes: a housing that encloses an inner volume; a movable divider within the inner volume, the movable divider dividing the inner volume into a first volume and a second volume; an x-ray tube within the first volume; the first volume between the housing and the x-ray tube filled with an insulating fluid; and the second volume filled with a compressible gas.

The inner volume may be cylindrical about a central axis and the movable divider may be a sliding piston that slides along the direction of the central axis. The sliding piston may have a cylindrical outer surface that engages a cylindrical inner surface of the housing. There may be one or more seals disposed between the sliding piston and the housing, the one or more seals separating the insulating fluid in the first volume and the compressible gas in the second volume. The sliding piston may have a range of travel to allow the insulating fluid to expand throughout a range of operating temperature of the x-ray tube assembly. The housing may be formed of a metal and the sliding piston is formed of an electrically insulating material. The housing may be formed of bronze and the sliding piston may be formed of Delrin. A high-voltage conductor may extend through the first volume, the high-voltage conductor electrically isolated from the insulating fluid by one or more layers of solid insulation that extend about the high-voltage conductor. The one or more layers of solid insulation may include Ethylene Propylene Rubber (EPR) insulation extending about and in contact with the electrical conductor and Viton shrink tubing extending about and in contact with the EPR insulation, the Viton shrink tubing having an outer surface in contact with the insulating fluid. A connector may be attached to the high-voltage conductor, a joint between the connector and the high-voltage conductor sealed and insulated by high-temperature epoxy and the Viton shrink tubing. The insulating fluid may be a thermally convecting and electrically insulating fluid that fills the first volume between the housing and the x-ray tube without bubbles. The insulating fluid may be transformer oil.

An example of an x-ray apparatus includes: an x-ray source comprising: a metal housing that encloses an inner volume; a movable divider within the inner volume, the movable divider dividing the inner volume into an oil-filled volume and a gas filled volume; a high-voltage conductor within the oil-filled volume, the high-voltage conductor covered by solid electrical insulator; an x-ray tube within the oil-filled volume, the x-ray tube having a high-voltage terminal connected to the high-voltage conductor, the x-ray tube configured to generate x-ray radiation; an x-ray receiver configured to receive x-ray radiation from an object exposed to the x-ray source; and one or more control circuits configured to receive an input from the x-ray receiver and configured to provide an output according to the input, the output indicating a characteristic of the object.

A pump and a heat exchanger may be connected to the oil-filled volume, the pump and the heat exchanger configured to maintain oil in the oil-filled volume below a threshold temperature. The x-ray receiver may be configured to receive x-ray radiation that passes through the object and the output may indicate thickness of the object. The x-ray receiver may be configured to receive fluorescent x-ray radiation emitted by the object exposed to the x-ray source and the one or more control circuits configured to provide the output according to composition of the object.

An example of a method of housing an x-ray tube includes: placing a movable divider within an inner volume formed in a metal housing, the movable divider dividing the inner volume into a first volume and a second volume; placing the x-ray tube in the first volume; and filling the first volume with an oil. The movable piston divider may be preset during fill to allow for appropriate expansion/contraction of fluid during thermal cycles.

A high-voltage electrical conductor encased in a solid insulator may be placed in the first volume and the high-voltage electrical conductor may be connected to a high-voltage terminal of the x-ray tube. A pump and a heat exchanger may be coupled to the first volume, the pump and the heat exchanger filled with the oil.

Note that the discussion above introduces many different features and many embodiments. It is to be understood that the above-described embodiments are not all mutually exclusive. That is, the features described above (even when described separately) can be combined in one or multiple embodiments.

For purposes of this document, it should be noted that the dimensions of the various features depicted in the Figures may not necessarily be drawn to scale.

For purposes of this document, reference in the specification to "an embodiment," "one embodiment," "some embodiments," or "another embodiment" may be used to describe different embodiments or the same embodiment.

For purposes of this document, a connection may be a direct connection or an indirect connection (e.g., via one or more other parts). In some cases, when an element is referred to as being connected or coupled to another element, the element may be directly connected to the other element or indirectly connected to the other element via intervening elements. When an element is referred to as being directly connected to another element, then there are no intervening elements between the element and the other element. Two devices are "in communication" if they are directly or indirectly connected so that they can communicate electronic signals between them.

For purposes of this document, the term "based on" may be read as "based at least in part on."

For purposes of this document, without additional context, use of numerical terms such as a "first" object, a "second" object, and a "third" object may not imply an ordering of objects, but may instead be used for identification purposes to identify different objects.

For purposes of this document, the term "set" of objects may refer to a "set" of one or more of the objects.

The foregoing detailed description has been presented for purposes of illustration and description. It is not intended to be exhaustive or to limit the subject matter claimed herein to the precise form(s) disclosed. Many modifications and variations are possible in light of the above teachings. The described embodiments were chosen in order to best explain the principles of the disclosed technology and its practical application to thereby enable others skilled in the art to best utilize the technology in various embodiments and with various modifications as are suited to the particular use contemplated. It is intended that the scope of be defined by the claims appended hereto.

What is claimed is:

1. An x-ray tube assembly comprising:

a housing that encloses an inner volume;

a movable divider within the inner volume, the movable divider dividing the inner volume into a first volume and a second volume, wherein the inner volume is cylindrical about a central axis and the movable divider is a sliding piston that slides along the direction of the central axis;

an x-ray tube within the first volume;

the first volume between the housing and the x-ray tube filled with an insulating fluid; and the second volume containing a compressible gas.

2. The x-ray tube assembly of claim 1 wherein the sliding piston has a cylindrical outer surface that engages a cylindrical inner surface of the housing.

3. The x-ray tube assembly of claim 2 further comprising one or more seals disposed between the sliding piston and the housing, the one or more seals separating the insulating fluid in the first volume and the compressible gas in the second volume.

4. The x-ray tube assembly of claim 3 wherein the sliding piston has a range of travel to allow the insulating fluid to expand/contract throughout a range of operating temperature of the x-ray tube assembly.

5. The x-ray tube assembly of claim 4 wherein the housing is formed of a metal and the sliding piston is formed of an electrically insulating material.

6. The x-ray tube assembly of claim 5 wherein the housing is formed of bronze or radiation shielding material.

7. The x-ray tube assembly of claim 1 further comprising a high-voltage conductor extending through the first volume, the high-voltage conductor electrically isolated from the insulating fluid by one or more layers of solid insulation that extend about the high-voltage conductor.

8. The x-ray tube assembly of claim 7 wherein the one or more layers of solid insulation comprises Ethylene Propylene Rubber(EPR) insulation extending about and in contact with the high-voltage conductor and shrink tubing extending about and in contact with the EPR insulation, the shrink tubing having an outer surface in contact with the insulating fluid.

9. The x-ray tube assembly of claim 8 further comprising a connector attached to the high-voltage conductor, a joint between the connector and the high-voltage conductor sealed and insulated by high-temperature epoxy and the shrink tubing completely cover and protect the EPR insulation.

10. The x-ray tube of claim 1 wherein the insulating fluid is a thermally conductive and electrically insulating fluid that fills the first volume between the housing and the x-ray tube without bubbles and convects heat away.

11. The x-ray tube of claim 1 wherein the insulating fluid is transformer oil.

12. The x-ray tube of claim 1 wherein the compressible gas is air that is vented to atmosphere outside of the housing.

13. An x-ray apparatus comprising:

an x-ray source comprising:

a metal housing that encloses an inner volume and radiation shields;

a movable divider within the inner volume, the movable divider dividing the inner volume into an oil-filled volume and a gas filled volume;

a high-voltage conductor within the oil-filled volume, the high-voltage conductor covered by solid electrical insulator;

an x-ray tube within the oil-filled volume, the x-ray tube having a high-voltage terminal connected to the high-voltage conductor, the x-ray tube configured to generate x-ray radiation;

an x-ray receiver configured to receive x-ray radiation from an object exposed to the x-ray source; and one or more control circuits configured to receive an input from the x-ray receiver and configured to provide an output according to the input, the output indicating a characteristic of the object.

14. The x-ray apparatus of claim 13 further comprising a pump and a heat exchanger connected to the oil-filled volume, the pump and the heat exchanger configured to maintain oil in the oil-filled volume below a threshold temperature.

15. The x-ray apparatus of claim 13 wherein the x-ray receiver is configured to receive x-ray radiation that passes through the object and the output indicates thickness of the object.

16. The x-ray apparatus of claim 13 wherein the x-ray receiver is configured to receive fluorescent x-ray radiation emitted by the object exposed to the x-ray source and the one or more control circuits are configured to provide the output according to composition of the object.

17. A method of housing an x-ray tube comprising:

placing a movable divider within an inner volume formed in a metal housing, the movable divider dividing the inner volume into a first volume and a second volume;

placing the x-ray tube in the first volume;

placing a high-voltage electrical conductor encased in a solid insulator in the first volume;

connecting the high-voltage electrical conductor to a high-voltage terminal of the x-ray tube; and filling the first volume with an oil while the second volume is filled with gas.

18. The method of claim 17 further comprising coupling a pump and a heat exchanger to the first volume, the pump and the heat exchanger filled with the oil.

19. An x-ray tube assembly comprising:

a housing that encloses an inner volume;

a movable divider within the inner volume, the movable divider dividing the inner volume into a first volume and a second volume;

an x-ray tube within the first volume;

the first volume between the housing and the x-ray tube filled with an insulating fluid;

the second volume containing a compressible gas; and a high-voltage conductor extending through the first volume, the high-voltage conductor electrically isolated from the insulating fluid by one or more layers of solid insulation that extend about the high-voltage conductor.

20. The x-ray tube assembly of claim 19 wherein the sliding piston has a cylindrical outer surface that engages a cylindrical inner surface of the housing.

21. The x-ray tube assembly of claim 20 further comprising one or more seals disposed between the sliding piston and the housing, the one or more seals separating the insulating fluid in the first volume and the compressible gas in the second volume.

22. The x-ray tube assembly of claim 21 wherein the sliding piston has a range of travel to allow the insulating fluid to expand/contract throughout a range of operating temperature of the x-ray tube assembly.

23. The x-ray tube assembly of claim 22 wherein the housing is formed of a metal and the sliding piston is formed of an electrically insulating material.

24. The x-ray tube assembly of claim 23 wherein the housing is formed of bronze or radiation shielding material.

25. The x-ray tube assembly of claim 19 wherein the one or more layers of solid insulation comprises Ethylene Propylene Rubber (EPR) insulation extending about and in contact with the high-voltage conductor and shrink tubing extending about and in contact with the EPR insulation, the shrink tubing having an outer surface in contact with the insulating fluid.

26. The x-ray tube assembly of claim 25 further comprising a connector attached to the high-voltage conductor, a joint between the connector and the high-voltage conductor sealed and insulated by high-temperature epoxy and the shrink tubing completely cover and protect the EPR rubber.

27. The x-ray tube of claim 19 wherein the insulating fluid is a thermally conductive and electrically insulating fluid that fills the first volume between the housing and the x-ray tube without bubbles and convects heat away.

28. The x-ray tube of claim 19 wherein the insulating fluid is transformer oil.

29. The x-ray tube of claim 19 wherein the compressible gas is air that is vented to atmosphere outside of the housing.

* * * * *